US005253898A

United States Patent [19]

Mangione

[11] Patent Number: 5,253,898

[45] Date of Patent: Oct. 19, 1993

[54] TELEGRAM BLANK

[75] Inventor: Luciano Mangione, Siccomario, Italy

[73] Assignee: Send Italia S.p.A., Rome, Italy

[21] Appl. No.: 886,131

[22] Filed: May 20, 1992

[30] Foreign Application Priority Data

May 21, 1991 [IT] Italy ..... TO91 U 000110

[51] Int. Cl.[5] ..... B42D 15/00

[52] U.S. Cl. ..... 283/62; 229/69; 229/72; 283/101; 283/105; 283/106; 283/61

[58] Field of Search ..... 283/100, 101, 103, 105, 283/106, 61, 62; 462/67; 229/69, 72, 92.8, 92.1

[56] References Cited

U.S. PATENT DOCUMENTS 4,368,903 4/1983 Jones ..... 283/101
4,428,526 1/1984 Riley ..... 283/106 X
4,598,860 7/1986 Pennock ..... 283/106 X

FOREIGN PATENT DOCUMENTS 247998 1/1948 Switzerland ..... 462/68

*Primary Examiner*—Paul A. Bell
*Attorney, Agent, or Firm*—Baker & Daniels

[57] ABSTRACT

A telegram blank is described comprising a single sheet printed on only one face and sub-divided into three portions a first of which defines a telegram destination and identification field and the second consecutive to the first, defines a telegram text field After printing the three portions are folded in zig zag fashion and glued together along glue strips in such a way that the identification field remains visible from the outside and the third portion covers the text field. The first portion is provided with a delivery confirmation zone delimited by perforated lines to facilitate separation thereof, and the longitudinal edges of the blank are also provided with perforated lines to facilitate opening the telegram.

5 Claims, 2 Drawing Sheets

TELEGRAM BLANK

BACKGROUND OF THE INVENTION

The present invention relates to a telegram blank.

As is known, telegrams are currently delivered in the form of a message printed on a support sheet enclosed in a sealed envelope; generally the addressee and address are printed on the sheet containing the message and are visible through a transparent window in the envelope. Usually, moreover, upon delivery the signature of the recipient is required on a suitable record book held by the postman or the employee to confirm that delivery has taken place.

Known telegram blanks suffer from the disadvantage that they require various operations for printing the message and enclosing in the envelope, as well as the fact that for each delivery the employee must transport the delivery record book, which is usually bulky and heavy.

SUMMARY OF THE INVENTION

The object of the present invention is to provide an improved telegram blank which on the one hand can be filled in and closed simply by mechanical means, with the maximum guarantee of confidentiality for messages contained therein, and on the other hand has low manufacturing costs.

According to the present invention, there is provided a telegram blank characterised by the fact that it comprises a single sheet folded in at least two portions defining, respectively, a telegram identification and destination field and a telegram text field, the said portions being folded and glued together along glue strips in such a way as to enclose the said text field on the inside.

BRIEF DESCRIPTION OF THE DRAWINGS

For a better understanding of the present invention a preferred embodiment of it will now be described purely by way of non-limitative example, with reference to the attached drawings in which.

DESCRIPTION OF THE INVENTION

Figure 1:
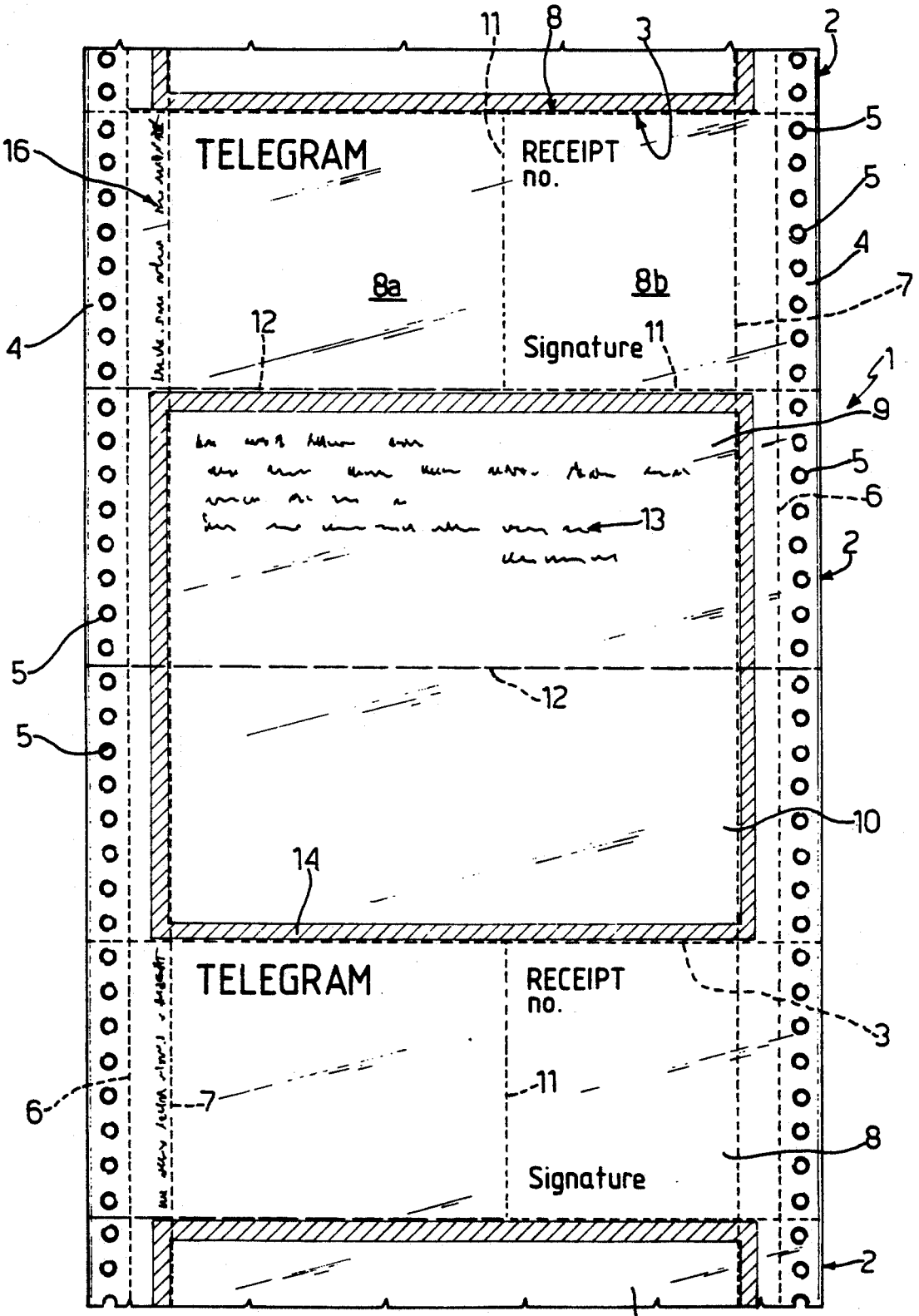
FIG. 1 is a front face view of a continuous form defining a plurality of telegram blanks according to the invention.

With reference to FIG. 1, the telegram blank shown is formed as part of a continuous form, generally indicated with reference numeral 1 in the drawing, of relatively thick paper or card on which are provided several blanks 2 disposed consecutively and separated from one another by perforated separation lines 3 (indicated in the Figure by short dash lines) which facilitate separation after the telegram text has been printed. The two longitudinal edges 4 of the form 1 are provided in the usual way with drive holes 5 and are delimited by a respective perforated line 6, also for facilitating the separation and removal of the borders 4. Moreover, a second perforated line 7 extends parallel to and a short distance from each perforated line 6, within the form 1, to facilitate opening of the telegram by the recipient as will be indicated in more detail below.

Figure 3:
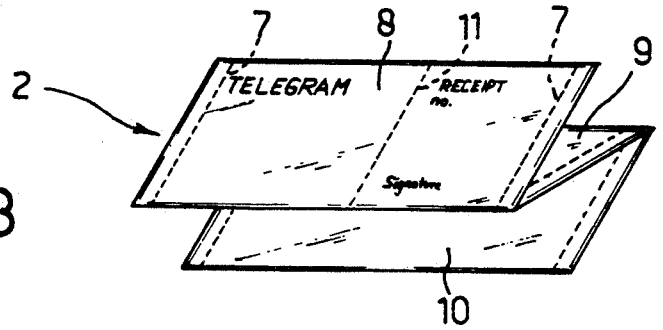
FIG. 3 is a perspective view of the telegram during folding.

Each blank 2 is formed by three equal portions, respectively 8,9,10, each of which extends over the entire width of the form i with the exception of the edges 4, and are intended to be folded in a zig zag fashion along fold lines 12 in the manner shown in FIG. 3, in such a way that the portion 9 is closed between the portions 8 and 10.

The portion 8 is divided into two parts 8*a* and 8*b* by a perforated line 11 which has a first section transverse the portion 8 and a second section extending along the fold line 12 between the portions 8 and 9. The part 8*b* is intended to be removed upon delivery, after having been signed by the recipient (and for this purpose on the front face of the blank 2, visible in FIGS. 1 and 3, can be provided a suitable zone indicated by the word "signature". The two parts 8*a* and 8*b* define fields in which, upon printing of the telegram, the data identifying the telegram itself, together with the address of the recipient and possibly that of the sender, the date and the time are all inserted. Advantageously, this data is printed in the usual way upon both parts so that even after removal of the part 8*b* both the telegram and the receipt part 8*b* carry all the data necessary for possible location.

Figure 2:
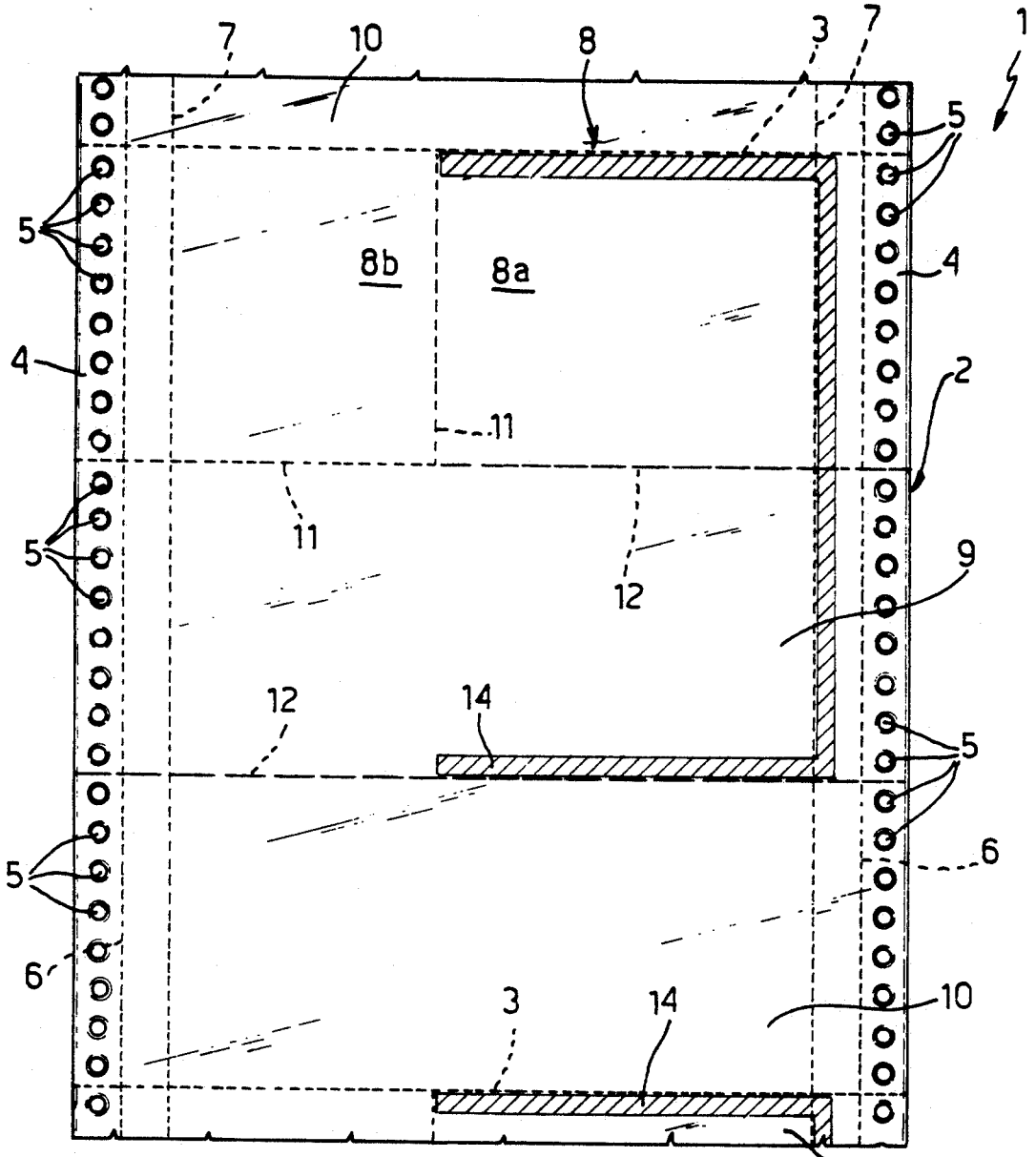
FIG. 2 is a rear view of the same form as in FIG. 1.

The front of the portion 9 (shown in FIG. 1) is intended to be printed with the text of the telegram, as symbolized in FIG. 1 by the writing 13, whilst the portion 10 serves only for closure and is not generally written on. To facilitate the closure of the blank 2, there are provided zones 14, shown hatched in the drawings, provided with a layer of glue. That is, a substantially annular layer of glue 14 is provided on the front face of each blank 2 and extends over the portion 9 close to the edge contiguous to the portion 8, then close to the outer edges of the portions 9 and 10 between the lines 6 and 7 and on the portion 10 close to the separation line (FIG. 1). Moreover, a substantially C-shape strip of glue is provided on the rear face of each blank 2, that is on the part 8*a* (see FIG. 2) close to the separation line 3 close to its outer edge, again between the perforated lines 6 and 7 and then continuing along the portion 9 on its outer edge close to the edge contiguous to the portion 10 in a position facing the line provided on part 8*a*.

When a telegram is to be compiled, the parts 8*a* and 8*b* of a blank 2 are compiled with the data identifying the telegram and then the telegram text 13 is printed on the portion 9 by printing on a tractor drive system to which a form 1 has been introduced. Then the printed blank 2 is mechanically separated from the subsequent blank 2 folded along the fold lines 12 in the manner shown in FIG. 3, so as to allow mutual gluing of the glued zones 14 and then definitive closure of the telegram. In this way the data identifying the telegram on the portion 8 remain in view whilst the text 13 on the portion 9 is enclosed and glued between the portions 8 and 10 and is not legible without opening the telegram. Subsequently (or even before folding) the drive edges 14 are torn off.

Upon delivery, after signature by the recipient in the zone provided in part 8*b*, the employee separates the part 8*b* using the perforated lines 11 and 7. This separation is further facilitated by the fact that the part 8*b* is not glued to the portion 9. In any case, this separation does not involve access to the text 13 which is printed on the face of the portion 9 facing the portion 10 and therefore opposite that uncovered upon removal of the part 8*b*. To open the telegram the recipient will only have to separate the glued lateral edges of the blank 1 by tearing them off along the lines 7 (for this purpose appropriate writing symbolically shown with the reference numeral 16 in FIG. 1 can be provided), and separate the mutually glued edges of the portions 9 and 10.

The advantages which can be obtained with the telegram blank described are as follows. First, the whole blank is formed from a single element which is printed and folded without needing to be put into an envelope, with evident advantages of speed. Furthermore, the delivery employee does not have to carry heavy and bulky register books for certifying delivery, given that the certification is provided by the part 8*b* separated directly from the telegram.

The blank described guarantees the maximum confidentiality of the text sent given that, after printing of the text on the portion 9 the blank is folded, glued and separated from the remainder of the form by mechanical means without requiring the intervention of employees, and subsequently the text 13 is not legible until after opening of the telegram after delivery.

Thanks to the possibility of mechanising the majority of the operations relating to the closure of the blank, and thanks to the economy of material utilized for the continuous forms, the overall cost for the preparation of telegrams is low. For this purpose it is also advantageous that all the identifying data and the telegram text are printed on the same face of the blank without requiring its separation from the form, or turning over and printing on the either side.

Finally, it is clear that the telegram blank described and illustrated here can have modifications and variations introduced thereto without by this departing from the protective ambit of the present invention. In particular, the fact is to be underlined that although the preferred and most advantageous embodiment from the manufacturing and economic point of view has been shown, the blanks 2 could be constituted by separate sheets rather than being joined in a continuous form. Moreover, if the receipt part 8*b* were dispensed with the blank could be constituted solely by two parts, printed on the two faces, and in this case one face would contain the telegram text and would be folded internally and sealed whilst the other face would contain the address and the other identification data, and would still be legible after folding. In this case the drive edges 4 could also be dispensed with and transport of the blank obtained solely by friction. Obviously, the glue strips 14 can be disposed differently, in particular, rather than being continuous as shown in the drawings, they could be provided simply as discontinuous lines as long as they were able to ensure closure of the blank 2.

I claim:

1. A telegram blank comprising a single sheet foldable into first and second outer portions and an intermediate portion connected together along folded lines, each said portion being of the same dimension, said three portions being printed on the same face of the blank and adapted to be folded zig zag fashion, said first outer portion defining a telegram destination and identification field, said intermediate portion defining a telegram text field, said second outer portion arranged to be folded over said telegram text field and glued together along glue strips in such a way as to enclose said telegram text field inside, said first outer portion including a perforated line having a first section extending transversely through said first outer portion and a second section extending along a fold line, said perforated line dividing said first outer portion into two parts, one of said parts being separable for confirmation of delivery, said separable part not being provided with glue strips.

2. The blank of claim 1 wherein said single sheet has perforated separation lines extending through said three portions to define at least two counterposed edge zones.

3. The blank of claim 1 wherein said glue strips extend along peripheral edges of said telegram text field.

4. The blank of claim 3 wherein perforated separation lines extend through said three portions, and a portion of said glue strips extends between said perforated separation lines and respective adjacent edges of said three portions.

5. The blank of claim 1 wherein said blank has longitudinal edges extending across said three portions provided with drive holes separable from said blank by perforated border lines whereby said blank may be formed in a continuous form comprising a plurality of said blanks disposed consecutively and separated from one another by perforated lines.

* * * * *